US007661227B2

(12) United States Patent
Dudley et al.

(10) Patent No.: US 7,661,227 B2
(45) Date of Patent: Feb. 16, 2010

(54) COVER FOR COVERING AN OPENING IN A BUILDING

(75) Inventors: Hayden Dudley, 212 Coolidge Dr., Sarasota, FL (US) 34236; Jeffrey Peterson, 1707 Waldemere St., Sarasota, FL (US) 34239

(73) Assignees: Hayden Dudley, Sarasota, FL (US); Jeffrey Peterson, Sarasota, FL (US)

( * ) Notice: Subject to any disclaimer, the term of this patent is extended or adjusted under 35 U.S.C. 154(b) by 0 days.

(21) Appl. No.: 11/972,822

(22) Filed: Jan. 11, 2008

(65) Prior Publication Data

US 2008/0168731 A1 Jul. 17, 2008

(51) Int. Cl.

| | |
|---|---|
| ***E06B 7/16*** | (2006.01) |
| ***E06B 3/70*** | (2006.01) |
| ***E04C 2/38*** | (2006.01) |
| ***E04C 2/54*** | (2006.01) |

(52) U.S. Cl. ..... 49/501; 49/503; 52/455; 52/656.4; 52/784.1; 52/656.9

(58) Field of Classification Search ..... 52/455, 52/456, 457, 458, 656.4, 656.9, 204.59, 204.61, 52/204.7, 784.1, 786.11, 787.1; 49/501, 49/503, 400, 394

See application file for complete search history.

(56) References Cited

U.S. PATENT DOCUMENTS

| | | | | |
|---|---|---|---|---|
| 161,965 | A | 4/1875 | Hurd | |
| RE6,549 | E | 7/1875 | Hurd | |
| 2,931,435 | A | 4/1960 | Neisewander | |
| 4,121,379 | A | 10/1978 | Everson | |
| 4,870,797 | A * | 10/1989 | Hagemeyer | 52/455 |
| 5,761,860 | A * | 6/1998 | Koike et al. | 52/204.67 |
| 5,778,629 | A | 7/1998 | Howes | |

(Continued)

FOREIGN PATENT DOCUMENTS

| | | |
|---|---|---|
| DE | 9203302 | 5/1992 |

(Continued)

OTHER PUBLICATIONS http://auto.howstuffworks.com/questions508.htm, "How Does Safety Glass Work?".

*Primary Examiner*—Robert J Canfield
*Assistant Examiner*—Babajide Demuren
(74) *Attorney, Agent, or Firm*—Dickinson Wright PLLC; William H Honaker

(57) ABSTRACT

An impact resistant door including a frame (24) presenting an inner wall (36) and defining a pane slot (58) and a flap slot (60) and a groove (62) along each side of the pane slot (58). The door includes a pane of laminated glass (46) having an inside sheet of glass (48) and an outside sheet of glass (50) sandwiched together and having oppositely facing outside surfaces (56) to define a pane width ($W_t$) therebetween. An interlayer (52) is adhesively sandwiched between the sheets of glass and presents an edge flap (54) extending along the periphery of the pane of laminated glass (46). The pane width ($W_t$) is disposed in the pane slot (58) and the edge flap (54) is disposed in the flap slot (60) of the frame (24). A plurality of inserts (64) engage the outside surfaces (56) of the glass, and each insert (64) includes a projection (68) extending into the groove (62) of the frame (24) along the adjacent outside surface (56) of glass.

1 Claim, 4 Drawing Sheets

U.S. PATENT DOCUMENTS

| | | | | |
|---|---|---|---|---|
| 5,937,611 | A | 8/1999 | Howes | |
| 6,021,610 | A | 2/2000 | Hunt | |
| 6,101,783 | A | 8/2000 | Howes | |
| 6,182,406 | B1 | 2/2001 | Hunt | |
| 6,250,040 | B1 * | 6/2001 | Green | 52/656.7 |
| 6,470,639 | B1 | 10/2002 | Horn et al. | |
| 6,688,063 | B1 | 2/2004 | Lee et al. | |
| 6,715,245 | B2 * | 4/2004 | Lewkowitz | 52/208 |
| 6,972,100 | B2 | 12/2005 | Minke et al. | |
| 7,243,463 | B1 | 7/2007 | Lucero | |
| 2001/0032422 | A1 | 10/2001 | Farrar | |
| 2002/0194804 | A1 | 12/2002 | Horn et al. | |
| 2003/0097799 | A1 * | 5/2003 | Herrmann et al. | 49/504 |
| 2003/0200714 | A1 | 10/2003 | Minke et al. | |
| 2004/0003559 | A1 | 1/2004 | Minke et al. | |
| 2004/0007797 | A1 | 1/2004 | Minke et al. | |
| 2004/0163776 | A1 | 8/2004 | Brown et al. | |
| 2004/0182006 | A1 | 9/2004 | Petty | |
| 2004/0226231 | A1 | 11/2004 | Dlubak | |
| 2006/0070347 | A1 | 4/2006 | Gupta et al. | |

FOREIGN PATENT DOCUMENTS

| | | |
|---|---|---|
| DE | 20305961 | 5/2004 |
| EP | 0803634 | 10/1997 |

* cited by examiner

COVER FOR COVERING AN OPENING IN A BUILDING

BACKGROUND OF THE INVENTION

1. Field of the Invention

The invention relates to a cover for covering an opening in a building.

2. Description of the Prior Art

U.S. Pat. No. 6,715,245, issued to Lewkowitz on Apr. 6, 2004, discloses a cover, shown as an impact resistant door, including a frame presenting an inner wall surrounding an opening. The inner wall presents a pane slot extending into the frame and about the opening. The cover includes a pane of glass presents outwardly and oppositely facing outside surfaces defining a pane width, and the pane width is disposed in the pane slot of the inner wall.

The covers of the prior art lack the ability to quickly and easily change in appearance without excessive modifications. It is desirable to have a cover which can facilitate the quick addition of a variety of inserts having different external appearances to modify the cover's appearance without having to make modifications to the cover.

SUMMARY OF THE INVENTION AND ADVANTAGES

The invention provides for such a cover and including the inner wall presenting a groove along at least one side of the pane slot of the frame. An insert engages one of the outside surfaces of the pane of glass, and includes a projection extending into the groove of the frame.

The insert provides a decorative feature to the cover by modifying the appearance of the door. The insert may be quickly removed by sliding the projection out of the groove of the frame of the cover, and an insert having a different decorative feature can be quickly and easily installed in its place.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
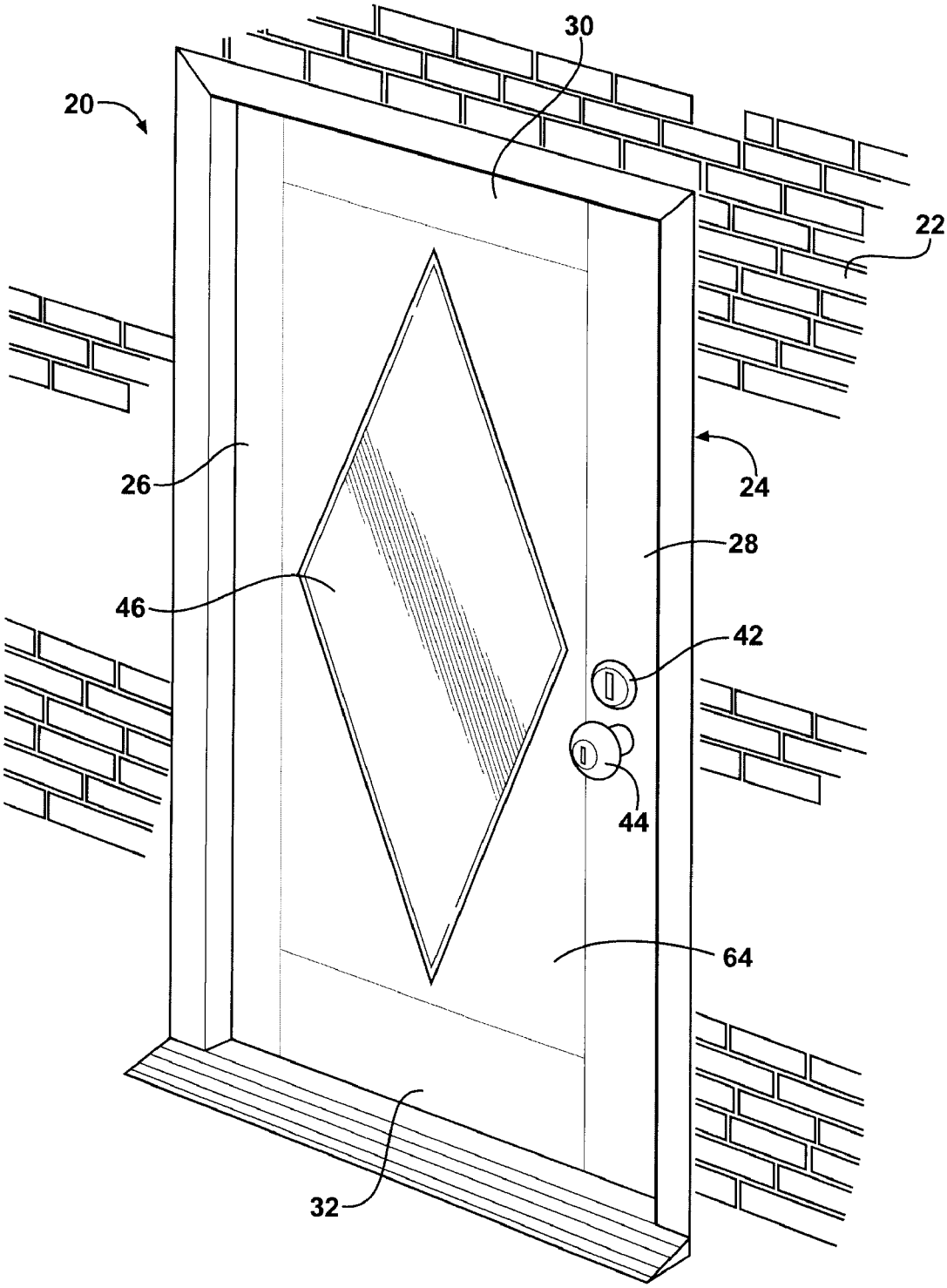
FIG. 1 is a perspective view of the subject invention in an installed state in the building.
Figure 2:
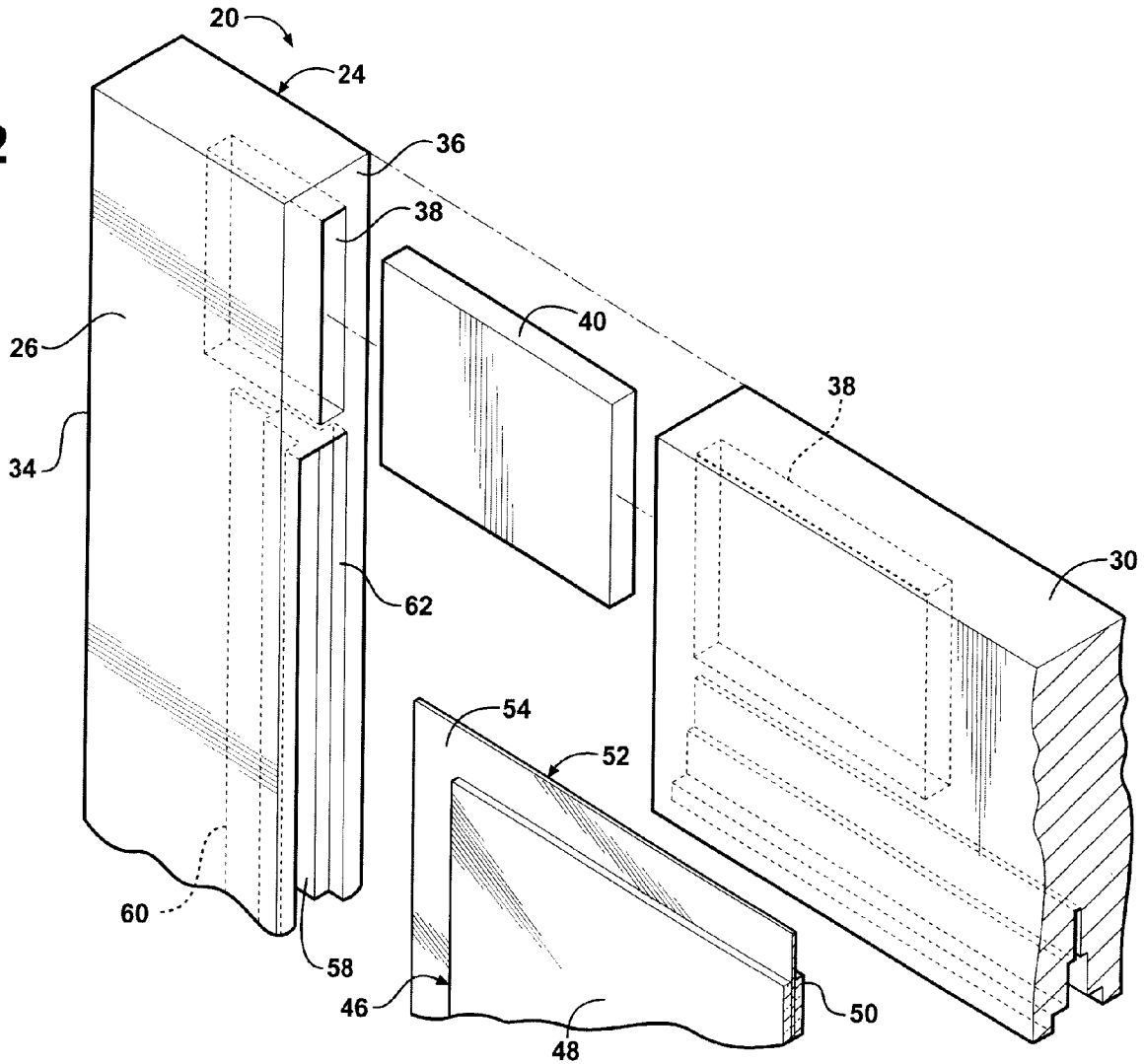
FIG. 2 is a an exploded and fragmentary view of one of the horizontal members and one of the vertical members and one of the dowels.
Figure 3:
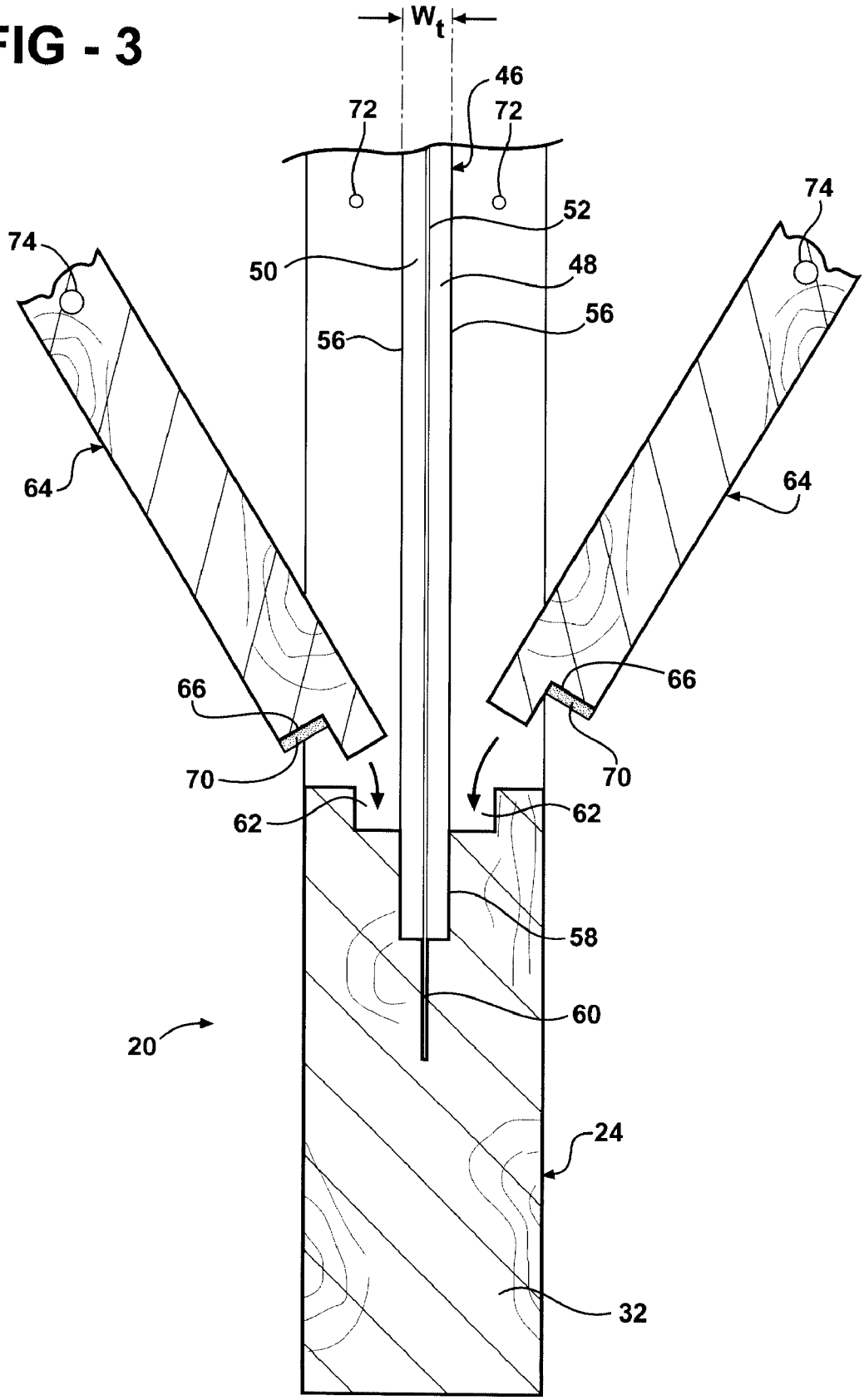
FIG. 3 is a cross-sectional and fragmentary view of the subject invention.
Figure 4:
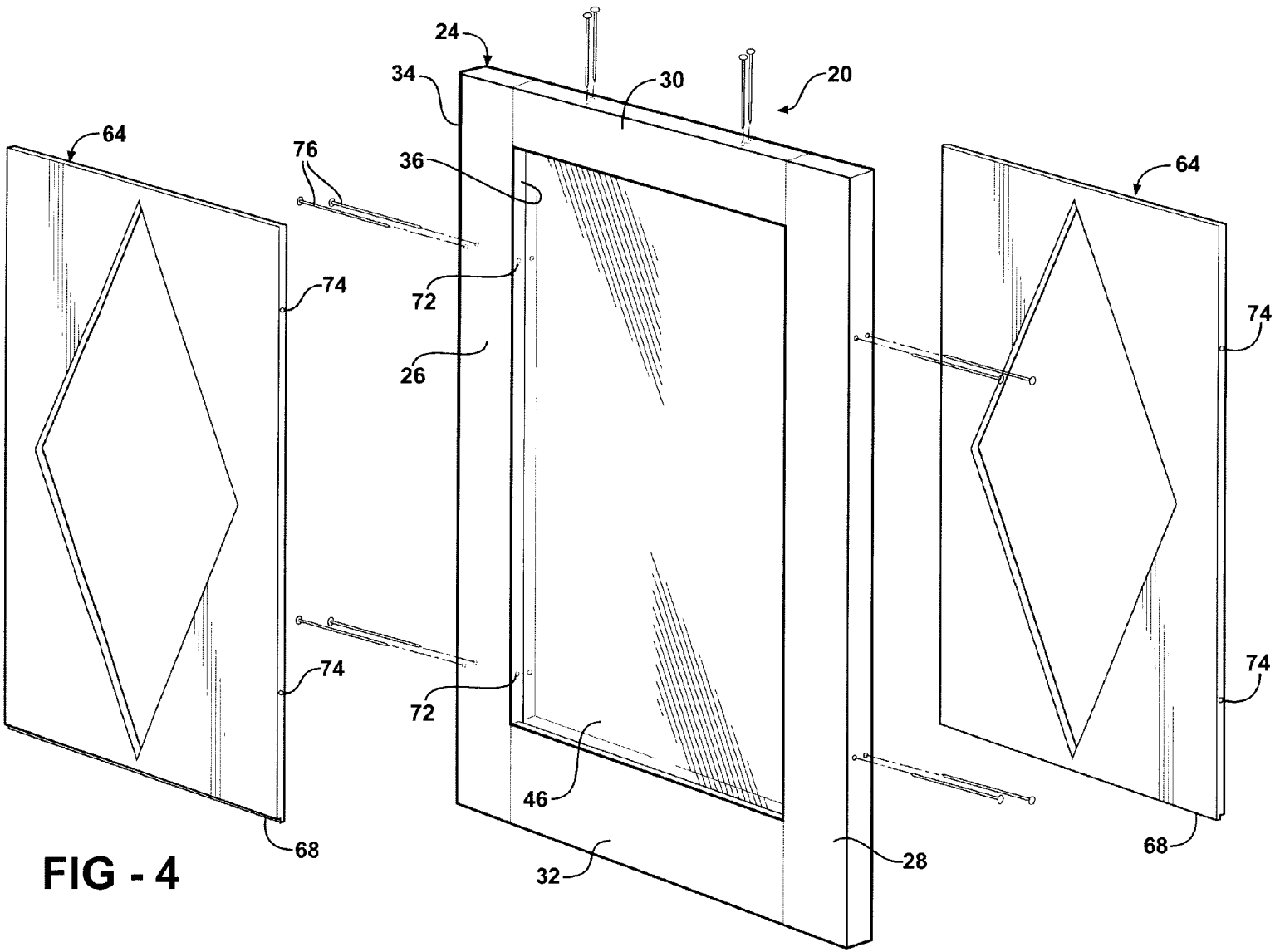
FIG. 4 is a perspective and exploded view of the subject invention.

Referring to the Figures, wherein like numerals indicate corresponding parts throughout the several views, a cover 20 for covering an opening in a building 22 is generally shown in FIGS. 1-4. In the preferred embodiment, the cover 20 is an impact resistant door for use in buildings 22 located in hurricane prone areas. However, the cover 20 could also be a set of double-doors or a window.

The cover 20 includes a frame 24 having a left vertical member 26 and a right vertical member 28 and a top horizontal member 30 and a bottom horizontal member 32 defining a rectangular shape. The rectangular frame 24 is generally indicated in FIGS. 1-4 and presents an outer wall 34 and an inner wall 36 and an opening. Each of the left and right vertical members 26, 28 presents an upper mortise 38 and a lower mortise 38 and each of the top and bottom horizontal members 30, 32 presents a left mortise 38 and a right mortise 38. A plurality of upper dowels 40 engage the upper mortises 38 of the vertical members 26, 28 and the left and right mortises 38 of the top horizontal member 30 and a plurality of lower dowels 40 engage the lower mortises 38 of the left and right vertical members 26, 28 and the left and right mortises 38 of the bottom horizontal member 32 for holding the frame 24 in the rectangular shape.

In the preferred embodiment, the frame 24 is made of a hardwood and the dowels 40 are glued into the mortise 38 joints for added strength. The top horizontal member 30 and the left and right vertical members 26, 28 are six inches wide and the bottom horizontal member 32 is ten inches wide.

At least one hinge is disposed on one of the left and right vertical members 26, 28 for allowing the door to swing open and closed. The hinge of the preferred embodiment is a concealed bearing hinge manufactured by Rocky Mountain Hardware and having the product number HNG2X4.

A lock 42 and a handle 44 are disposed on the other of the left and right vertical members 26, 28 opposite of the at least one hinge for securing the door to the building 22. A strong locking system is required for hurricane-proof impact resistant doors. One such locking system is the Multi-Point for Double Doors with T-Astragel AS7000 W240CP & AS7960 CP, which is manufactured by KFV.

The cover 20 includes a pane of laminated glass 46 including an inside sheet of glass 48 and an outside sheet of glass 50 sandwiched together and defining a rectangular periphery. In the preferred embodiment, an interlayer 52 is adhesively sandwiched between the inside and outside sheets of glass 48, 50 and has a rectangular periphery being greater than the rectangular periphery of the sheets of glass 48, 50 to present an edge flap 54 extending outwardly about the periphery of the inside and outside sheets of glass 48, 50 to a predetermined flap width. The inside and outside sheets of glass 48, 50 present outwardly and oppositely facing outside surfaces 56 to define a pane width $W_t$ therebetween.

In the preferred embodiment, the pane of laminated glass 46 must be constructed to be impact resistant and to withstand the potentially damaging effects of hurricanes. One example of such a hurricane-proof glass is Safety-Plus® II, which is manufactured by Glasslam International of Pompano Beach, Fla.

The inner wall 36 of the frame 24 presents a pane slot 58 extending about the frame 24, and the pane width $W_t$ of the pane of laminated glass 46 is disposed in the pane slot 58. The pane slot 58 is slightly larger than the pane width $W_t$ and a sealant is used to further secure the pane of laminated glass 46 to the frame 24 of the cover 20. In the preferred embodiment, the pane width $W_t$ is seven-sixteenths (7/16) inches thick and the pane slot 58 is nine-sixteenths (9/16) inches wide.

The inner wall 36 of the frame 24 presents a flap slot 60 extending from the pane slot 58 and into the frame 24, and the edge flap 54 of the interlayer 52 of the pane of laminated glass 46 is disposed in the flap slot 60. The inner wall 36 of the frame 24 presents a groove 62 along each side of the pane slot 58 and having a depth less than the pane slot 58.

A plurality of inserts 64 engage the outside surfaces 56 of the sheets of glass 48, 50. Each insert 64 has a bottom surface 66 overlying the inner wall 36 and includes a projection 68 extending into the groove 62 of the frame 24 along the adjacent outside surface 56. The projection 68 fits snugly into the groove 62 of the frame 24 to hold the insert 64 in place. A gasket 70 may be disposed on the bottom surface 66 of each of the inserts 64 for sealing the inserts 64 to the inner wall 36 of the frame 24.

The inserts 64 are used to enhance the appearance of the cover 20 and can be quickly changed to modify the appearance of the cover 20. For example, in the preferred embodiment, different inserts 64 can be used to make the door appear to be a solid wood doors a solid wood door with a small window, or a wood door with a large window having a particular shape.

A sealant is disposed in the groove 62 of the left and right vertical members 26, 28 and the top horizontal member 30. The sealant of the preferred embodiment is a polyurethane sealant manufactured by Schnee-Morehead and having a product number Cura Sil 2K & #.

In the preferred embodiment, the left and right vertical members 26, 28 and the top horizontal member 30 of the frame 24 define a plurality of frame holes 72 extending between the outer and inner walls 34, 36 of the frame 24 and being spaced from each other. The plurality of inserts 64 define a plurality of insert holes 74 spaced from each other and aligned with the frame holes 72. A pin 76 extends through each of the frame holes 72 and into the corresponding insert holes 74 for securing the inserts 64 to the frame 24. The pins 76 are easily removable to allow for quick and easy changing of the insert 64. Self-tapping screws or other fasteners may be used in place of the pins 76 to hold the inserts 64 to the frame 24.

The hurricane resistant door of the preferred embodiment is fit into and sealed to a jamb. Preferably, an Endura "Z" series seal is used to seal the door to the jamb against both water and air.

The cover 20 is constructed by precutting the mortises 38 into the left and right vertical members 26, 28 and the top and bottom horizontal members 30, 32. The pane of laminated glass 46 is preformed at the desired dimensions to properly fit the frame 24. The edge flap 54 and the pane width $W_p$ are inserted into the flap slot 60 and the pane slot 58 respectively and the dowels 40 are glued and inserted into the mortises 38. By pushing the horizontal and vertical members 26, 28 together, the cover 20 is formed. The projections 68 of the inserts 64 are then slid into the grooves 62 of the bottom horizontal member 32 of the frame 24, and the pins 76 are inserted through the frame holes 72 and the insert holes 74 to hold the inserts 64 against the outside surfaces 56 of the pane of laminated glass 46.

Obviously, many modifications and variations of the present invention are possible in light of the above teachings and may be practiced otherwise than as specifically described while within the scope of the appended claims. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A cover (20) for covering an opening in a building (22) comprising:

a frame (24) including a left vertical member (26) and a right vertical member (28) and a top horizontal member (30) and a bottom horizontal member (32) and defining a rectangular shape with an outer wall (34) and an inner wall (36) defining an opening, each of said left and right vertical members (26, 28) presenting an upper mortise (38) and a lower mortise (38) and each of said top and bottom horizontal members (30, 32) presenting a left mortise (38) and a right mortise (38), a plurality of upper dowels (40) engaging said upper mortises (38) of said vertical members (26, 28) and said left and right mortises (38) of said top horizontal member (30) and a plurality of lower dowels (40) engaging said lower mortises (38) of said left and right vertical members (26, 28) and said left and right mortises (38) of said bottom horizontal member (32) for holding said frame (24) in said rectangular shape, at least one hinge disposed on one of said left and right vertical members (26, 28) for allowing said cover (20) to swing open and closed, a lock (42) and a handle (44) disposed on the other of said left and right vertical members (26, 28) opposite of said at least one hinge for securing said cover (20) to the building (22), a pane of laminated glass (46) including an inside sheet of glass (48) and an outside sheet of glass (50) sandwiched together and defining a rectangular periphery, an interlayer (52) adhesively sandwiched between said inside and outside sheets of glass (48, 50) and having a rectangular periphery being greater than said rectangular periphery of said sheets of glass (48, 50) to present an edge flap (54) of said interlayer (52) extending outwardly about the periphery of said inside and outside sheets of glass (48, 50) to a predetermined flap width, said inside and outside sheets of glass (48, 50) presenting outwardly and oppositely facing outside surfaces (56) defining a pane width ($W_t$) therebetween, said inner wall (36) presenting a pane slot (58) extending into said frame (24) and about said opening, said pane width ($W_t$) disposed in said pane slot (58), said inner wall (36) presenting a flap slot (60) extending from said pane slot (58) and into said frame (24), said edge flap (54) of said interlayer (52) disposed in said flap slot (60), and said inner wall (36) presenting a groove (62) along each side of said pane slot (58) and having a depth less than said pane slot (58), a plurality of inserts (64) engaging said outside surfaces (56) of said sheets (48, 50), each insert (64) having a bottom surface (66) overlying said inner wall (36) and including a projection (68) extending into said groove (62) along the adjacent outside surface (56), a gasket (70) disposed on said bottom surfaces (66) for sealing said inserts (64) to said inner wall (36) of said frame (24), said left and right vertical members (26, 28) and said top horizontal member (30) defining a plurality of frame holes (72) extending between said outer and inner walls (34, 36) of said frame (24) and being spaced from each other, said plurality of inserts (64) defining a plurality of insert holes (74) spaced from each other and aligned with said frame holes (72) of said left and right vertical members (26, 28) and said top horizontal member (30), and a pin (76) extending through each of said frame holes (72) and into said corresponding insert holes (74) for securing said plurality of inserts (64) to said frame (24).

* * * * *